United States Patent [19]

Frudakis

[11] 4,344,625

[45] Aug. 17, 1982

[54] GAME ENCOURAGING SELF-IMPROVEMENT

[76] Inventor: Rosalie Frudakis, 2316 Locust St., Philadelphia, Pa. 19103

[21] Appl. No.: 152,203

[22] Filed: May 22, 1980

[51] Int. Cl.[3] ..... A63F 3/00

[52] U.S. Cl. ..... 273/242; 273/288; 273/249

[58] Field of Search ..... 273/243, 248, 249, 288, 273/251, 252, 254, 242; 434/237, 236, 238, 127, 245

[56] References Cited

U.S. PATENT DOCUMENTS

| | | | |
|---|---|---|---|
| 3,211,458 | 10/1965 | Wells | 273/248 |
| 4,040,628 | 8/1977 | Pope | 273/243 |
| 4,159,117 | 6/1979 | Kuna | 273/243 |
| 4,174,840 | 11/1979 | Curtiss | 273/243 |
| 4,201,388 | 5/1980 | Cantelon | 273/251 |

*Primary Examiner*—Richard C. Pinkham

*Assistant Examiner*—Carl Moy

*Attorney, Agent, or Firm*—Steele, Gould & Fried

[57] ABSTRACT

A board game for encouraging adherence to a self-improvement program, particularly a diet. The game comprises a board depicting a path to a goal and a plurality of playing pieces for each of one or more players, the playing pieces representing stages of development or achievement in the self-improvement program. The playing pieces are adapted to indicate the current positions of the players progressing along the path, and means are provided for rewarding the players for progress toward the goal. Progress toward the dieter's goal is indicated by use of human form playing pieces of progressively slimmer appearance, thereby reinforcing the player's will to succeed. Hazard and benefit spaces are provided along the path, as well as means for soliciting support from others, and for directing the players' frustration toward constructive ends.

5 Claims, 25 Drawing Figures

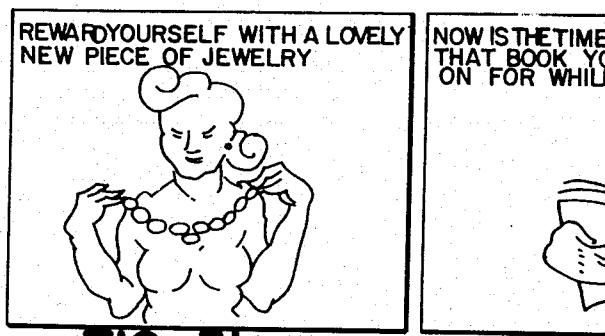
FIG. 5a
FIG. 5b
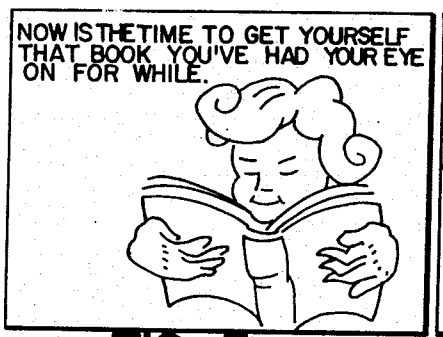
FIG. 5c
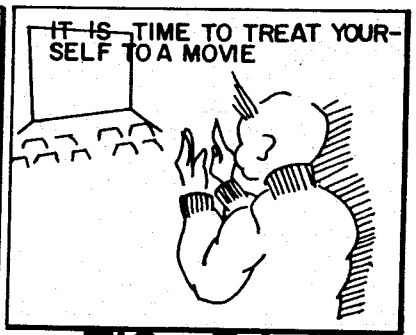
FIG. 5d
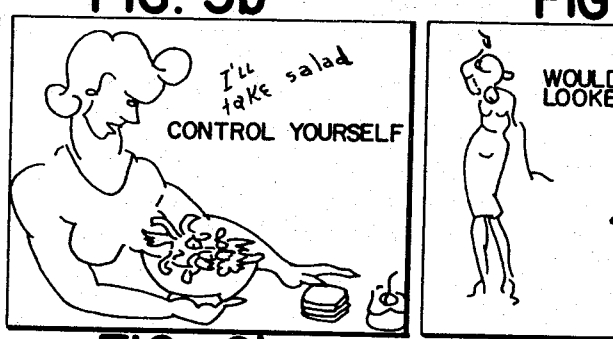
FIG. 6a
FIG. 6b
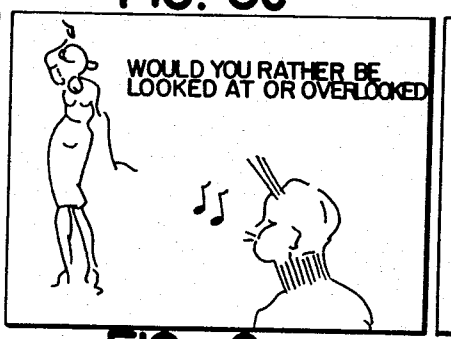
FIG. 6c
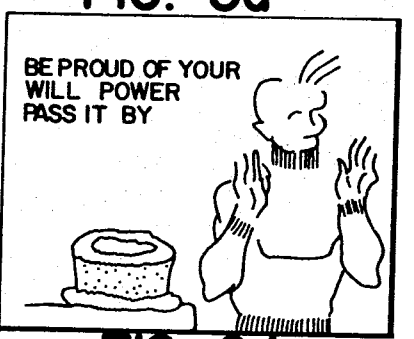
FIG. 6d
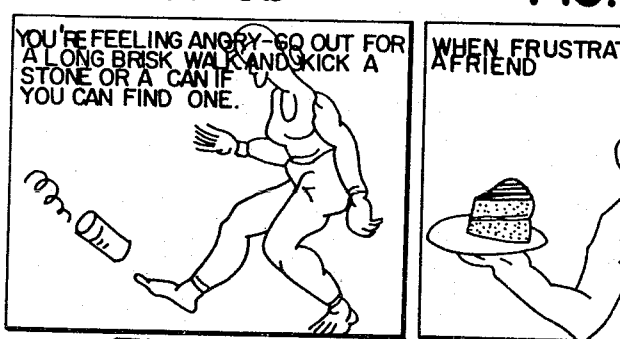
FIG. 7a
FIG. 7b
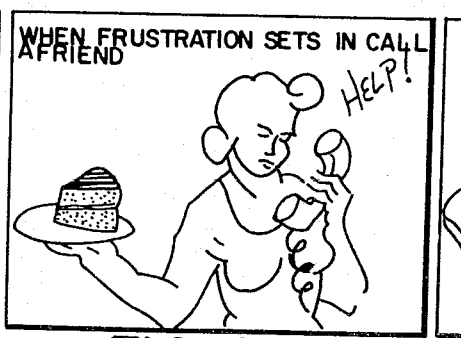
FIG. 7c
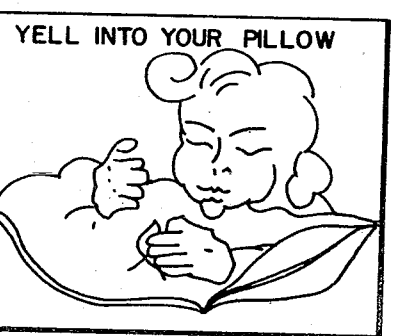
FIG. 7d

GAME ENCOURAGING SELF-IMPROVEMENT

BACKGROUND OF THE INVENTION

1. Field of the Invention

This invention relates to board games for encouraging player progress toward a desirable goal. In particular, the invention relates to a game for encouraging adherence to a diet program.

2. Description of the Prior Art

The prior art discloses a number of games having the dual goals of teaching good habits and providing diversion for the players. Some examples of these games include: U.S. Pat. No. 1,389,162—Reed, for encouraging health and hygiene habits; U.S. Pat. No. 1,631,505—Samis, for encouraging safety habits in children; U.S. Pat. No. 1,638,094—Gilmore, for teaching mental and moral lessons; and, U.S. Pat. No. 1,695,144—Edwards, for building character. Each of these games is competitive. Hazards for "bad" choices and benefits for "good" choices are encountered by the players during the progress of the game. Competition is said to be a major impetus for players to excel.

In addition to games wherein choices of proper behavior are rewarded, the prior art discloses numerous games in which chance rather than choice dictates the progress of the players. Although such games are said to simulate life, the fact that a player has little or no control over his progress tends to dilute the benefit of training. An example of such a game is U.S. Pat. No. 1,536,672—Hobbs, in which the roll of dice controls progress from office boy to president.

Some developments in the prior art have gone so far as to reward preferred traits or choices of players with food. Examples of such Patents are U.S. Pat. No. 3,897,064 Sonnabend, and U.S. Pat. No. 3,191,184—Durstewitz. The Durstewitz game is in fact directed to encouraging eating. A player takes his turn by unwrapping or partially consuming an article of food, thereby revealing the number of spaces he may move along the path towards the goal.

It should be noted that each of the foregoing games necessarily involves competition between players. Defeating the opposing player is one of the benefits of preferred performance. Where games in the prior art do not employ competition, such as U.S. Pat. No. 3,889,953—Grasham, the player is intended to be pitted against the board. In such a game, either complexity or random distribution of hazard and benefit spaces provide a competitive opponent for the player. Thus competition is involved even in solitary games.

Inasmuch as the present invention is particularly useful for encouraging dieting, matters not typical to games in general are implicated. Inasmuch as eating habits are sometimes nervous habits, and dieters are often compulsive eaters, the proper reinforcement for a dieting program should be subtle. When conducted in a group therapy environment, possibly under control of a psychologist, dieters can controllably support and reinforce one another with substantial success. The present invention provides a means for exertion of such control, and for mutual support and reinforcement. Optimum results are likely to be obtained for unsupervised dieters operating in private, free of frustrating or threatening comments which tend only to increase nervousness and compulsive eating. In any event, if more than a single player is involved, the optimum diet game should emphasize mutual support rather than all out competition.

SUMMARY OF THE INVENTION

It is an object of this invention to assist weight loss programs by a system of positive reinforcement peculiarly designed for use by dieters.

It is another object of this invention to keep a dieter's full attention during the progress of a diet.

It is another object of this invention to regulate all areas of a dieter's life, and not only eating, to thereby develop good habits of exercise and weight control.

It is yet another of this invention to encourage progress toward a goal by emphasizing progress and directing frustration toward constructive ends.

It is yet another object of this invention to solicit non-threatening support from colleagues in a self-improvement program.

These and other objects are accomplished by a game for encouraging adherence to a self-improvement program, comprising: a board having depicted thereon a path to a goal of said program; a plurality of playing pieces for each of one or more players, said playing pieces representing stages of development in the self-improvement program, and said playing pieces adapted to mark current positions of said players progressing along the path; and, means for rewarding said players for progress towards that goal. In the embodiment of a dieter's game, a segmented path represents incremental weight loss from a starting weight to a desired weight, said desired weight being the goal; said playing pieces depicting progressively slimmer human bodies, whereby the players are reinforced by visible improvement in appearance; and, said means for rewarding said players comprising reward cards authorizing enjoyable activities for said players, said reward cards being available to said players upon reaching spaced increments of progress upon the path to the goal.

Moral support is secured from other players, non-players and from the internal resources of the player. Progress along the path is at first a function of time, and later a function of weight loss. Legends on the playing board, as well as caution cards to be read by tempted players, extol the benefits of adherence to the program. Frustration cards can be read by players who are unsuccessful in that they progress backwards along the path to the goal, said frustration cards authorizing activities which redirect frustration toward harmless objects and away from said program.

BRIEF DESCRIPTION OF THE DRAWINGS

For the purpose of illustrating the invention, there are shown in the drawings forms which are presently preferred; it being understood, however, that this invention is not limited to the precise arrangements and instrumentalities shown.

FIG. 2(*b*) is a top plan view of the other half of the game board shown in FIG. 1;

FIGS. 5(*a*), 5(*b*), 5(*c*) and 5(*d*) are top plan views of sample reward cards according to this invention.

FIG. 6(*a*), 6(*b*), 6(*c*) and 6(*d*) are top plan views of sample caution cards according to this invention; and, FIGS. 7(*a*), 7(*b*), 7(*c*) and 7(*d*) are top plan views of sample frustration cards according to this invention.

DETAILED DESCRIPTION OF THE PREFERRED EMBODIMENTS

Figure 1:
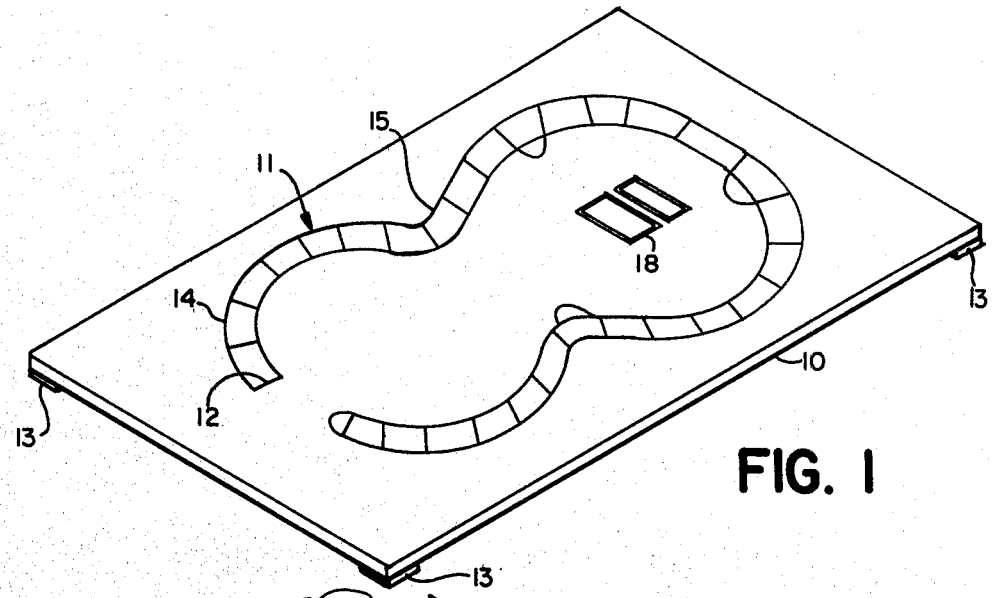
FIG. 1 is a perspective view of a game board according to this invention.
Figure 3A:
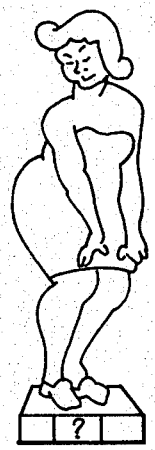
FIGS. 3(*a*), 3(*b*), 3(*c*) and 3(*d*)are top views of playing pieces according to this invention.
Figure 3B:
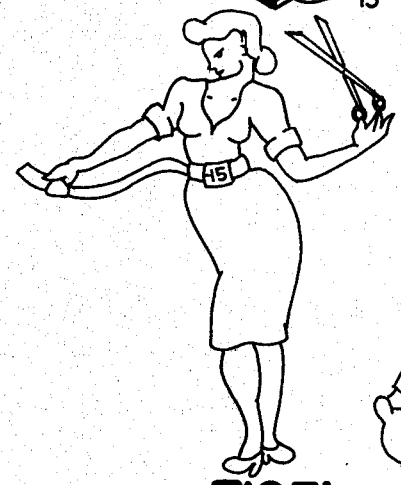
Figure 3C:
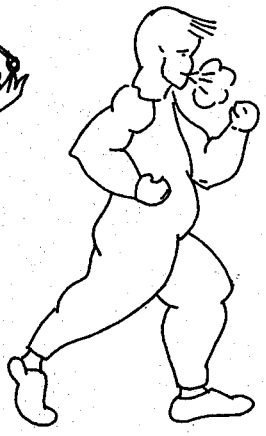
Figure 3D:
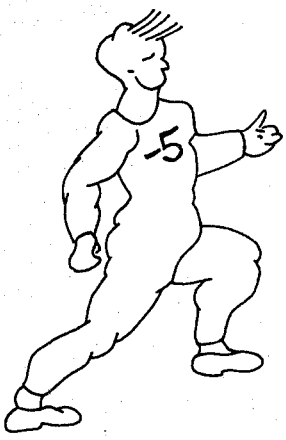
Figure 4A:
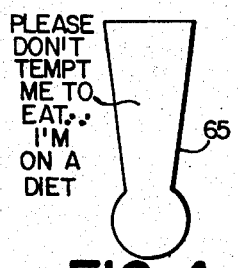
FIGS. 4(*a*), 4(*b*), 4(*c*), 4(*d*), 4(*e*) and 4(*f*) are top plan views of sample badges for securing moral support for players, according to this invention.
Figure 4B:
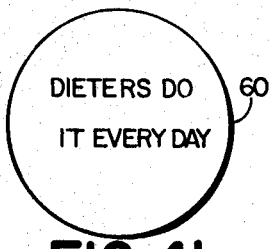
Figure 4C:
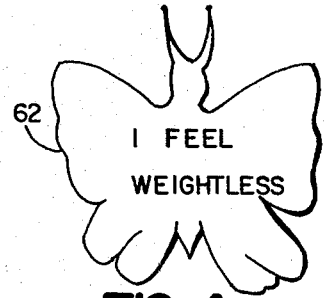
Figure 4D:
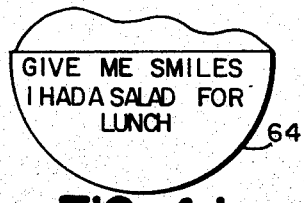
Figure 4E:
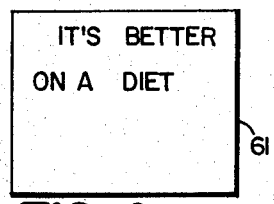
Figure 4F:
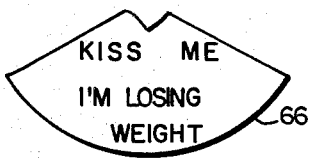
Figure 2A:
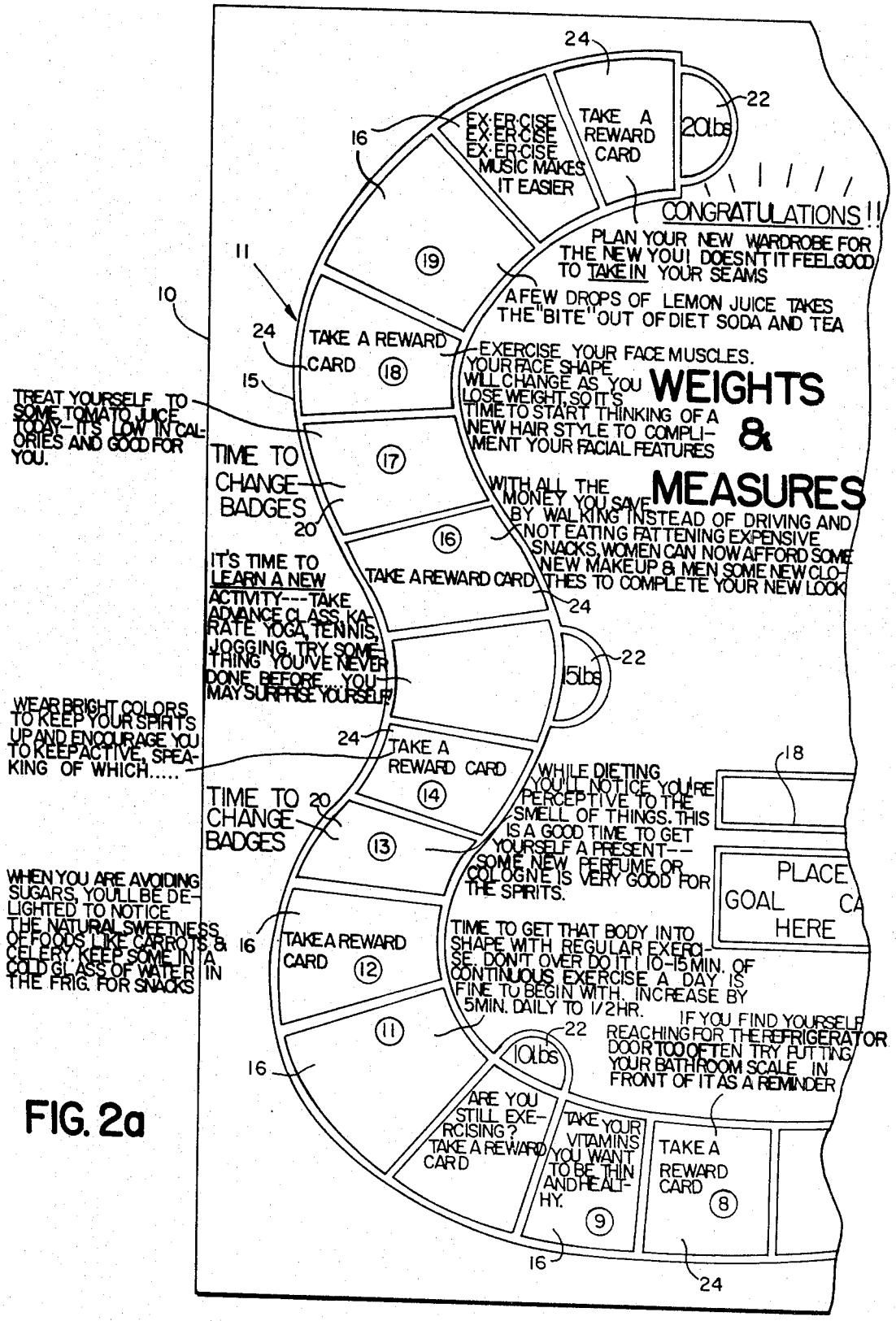
FIG. 2(*a*) is a top plan view of one half of the game board shown in FIG. 1.
Figure 2B:
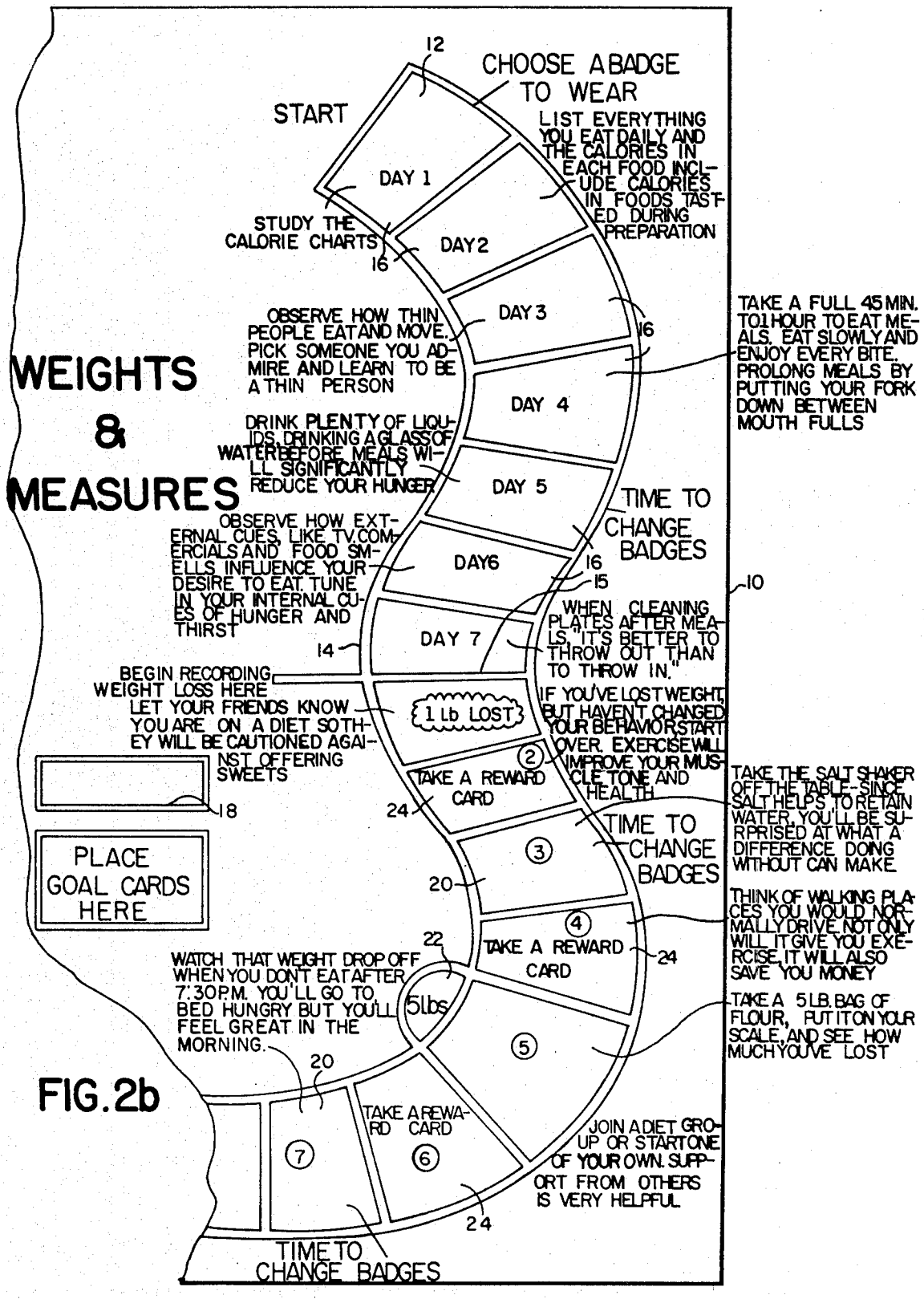

A game board 10 according to this invention is shown in FIG. 1 and more fully in FIGS. 2(*a*) and 2(*b*). The board is preferably made of cardboard or thick paper, and is intended to be hung in a convenient place, so as to be often encountered by the player. In the preferred embodiment, the board is made of thick paper, to be hung on a refrigerator by tape or magnetic mounting means 13. Playing pieces for marking the players' progress are magnetic and are affixed to the board by magnetic attraction to, for example, the refrigerator.

The board, as well as the other parts of the game, is designed to constantly remind the player of the objective. Playing route 11, on board 10, generally depicts the hour glass shape of a human figure. Route 11 also reflects the segmented appearance of a tape measure. The players' goal, for example a certain weight loss, is chosen at the beginning of a game cycle, and affixed in pocket 18. Thus, the player is constantly reminded of the goal.

Inasmuch as the danger of frustration and quitting are greatest when the player has first started the game, the player progresses from segment to segment by time rather than weight at the beginning of the game. The player starts the game at point 12 and progresses through section 14 based on the passage of time, for example, one segment per day. By this method, a player is not inclined to stop the diet because of a lack of immediate physical progress. Rather, without regard to weight loss the player is encouraged by progress from segment to segment through section 14. Legends encountered in each segment suggest a diet-related activity to be accomplished for each day, as well as helpful hints for dieters. Weight loss itself, however, is not a factor. For example, the dieter is encouraged to exercise, drink liquids, eat slowly, etc. During this starting section, the dieter is also encouraged to discover and remember the different sensory cues which serve as an impetus for eating. In the dieter's mind, progress toward the goal becomes associated with the sensory cues and recommended behaviors. This tends to specifically modify the dieter's behavior.

Upon starting the game, the player chooses a badge from the badges, as depicted in FIG. 4, which solicit support from family and friends. Once again, the shapes as well as the legends of the badges keep the objective in the dieter's mind. As shown in FIG. 4, the dieter may choose a geometric shape 60 or 61, the shape of a familiar object such as butterfly 62, a food shape such as salad 64, an exclamation mark 65, etc. Lip shape 66 even solicits kisses from supportive comrades.

With reference to FIGS. 1 and 2(*b*), upon passing progress-by-time section 14, the dieter enters progress-by-weight section 15 which extends along the rest of the route to the goal. The player changes badges at badge change points 20, and changes playing pieces, as explained more fully hereafter, at piece change points 22. These change points, as well as reward segments 24, are spread at different intervals along the route toward the goal. For example, badges are changed after five days upon reaching segment 14, and thereafter, after every three, four, or five pounds lost, as desired. Similarly, playing pieces are changed at intervals, for example each time five pounds are lost. Playing pieces are not changed before reaching segment 14. The playing pieces may also be provided with magnetic mounting means.

The player's progress along route 11 toward the goal is reflected by change in playing pieces as shown in FIG. 3. As the player progresses from a starting weight to a goal weight, progressively slimmer or more attractive pieces are used. In a preferred embodiment, the changing pieces depict human figures not only slimmer, but more athletic and happier as the player progresses along the route. For example, a first female starting figure shown in FIG. 3(*a*) is overweight and unable to read the scale on which she stands. Progressing through weight losses of five pounds, subsequent playing pieces of this series illustrate a slimmer figure on the scale, with weight loss indicated as "−5", "−10", "−15", etc. Another female series might depict a woman unable to touch her toes in the heaviest stage, the figures depicting progress toward toe touching and a slimmer figure. Another female figure may progress from being unable to close her belt, through being able to close the belt, through having too large a belt, and finally, shortening the belt as shown in FIG. 3(*b*). In this example, weight loss is indicated on the belt buckle. A typical male figure progresses from a puffing jogger in FIG. 3(*c*) toward an athletically-attired athlete, passing through FIG. 3(*d*) in the process. Each of these progressions provides visible positive reinforcement for the player of the game of this invention. Therefore, even if progress is slow, the player is encouraged by the figurative improvement in his or her appearance. Moreover, a player who chooses to go on a diet for a certain reason is encouraged by progress along the same lines. For example, a player who finds him or herself physically out of shape may be encouraged by an athletic progression whereas a player who found that his or her clothes were becoming too small would be encouraged by the narrow waist progression.

In addition to the reward of improved playing piece appearance, reward segments are distributed at spaced intervals along the route. Interspersed among legends in segments 16, is the additional legend "take a reward card". Sample reward cards are depicted in FIG. 5, ranging from "treat yourself to a movie" to "take a small trip". Rewards of food may be included in these reward cards, or allowed by legends at a different interval, provided the reward is not so large as to undo the progress gained. In a preferred embodiment, rewards each totaling 300 calories are available each time three pounds are lost, that is, each time three segments are passed.

Although positive reinforcement is known to be the most effective method of changing behavior, such reinforcement alone is not enough in the case of compulsive eating. In such a situation, where eating is a function of nervousness, steps must be taken to minimize the frustration and other nervous effects of dieting. For this purpose, caution cards as shown in FIG. 6, and frustration cards as shown in FIG. 7 are also provided. The caution cards of FIG. 6 are to be drawn when a player feels tempted to break the diet regime. The cards remind the player of the benefits to be gained from dieting, and encourage the player to remain on the diet. Similarly, frustration cards, as depicted in FIG. 7, direct an unsuccessful player's frustration away from the game. Harmless activities, such as beating a pillow or throwing out some unwanted item allow the player to direct frustration into harmless or preferably constructive activities. It is important that nervous frustration not be allowed to accumulate with the expected result that the dieter will quit playing the diet game. It is believed that approximately two dozen of each kind of card, and two dozen badges will be supplied. Players will also be provided with blank cards and badges, on which to write their own messages, rewards, etc.

It is also contemplated that a record or tape recording will be supplied which urges the players to relax, the recording being preferably prepared by a qualified psychologist, or the like.

Upon completion of a circuit from start to finish on route 11, the dieter may well wish to continue for an additional circuit or circuits. In this instance, the player should shuffle the reward, caution and frustration cards, choose a new piece and begin again. Successive circuits are preferably begun at progress-by-weight section 15 rather than at progress-by-time section 14, because the dieter has by this point successfully assimilated the behavior modification lessons of said progress-by-time sector. Additional circuits will provide additional reinforcement for the good eating habits to be gained by playing the game of the subject invention.

The game of this invention can be played by one or more players. The competitive spur of multiple players can provide an impetus for a player to excel. Nevertheless, in the peculiar situation of dieting, the frustration of an unsuccessful competitor may result in the game being stopped before completion of a circuit. Accordingly, the unsupervised player should be alert to the effect of frustration upon themselves, and to play the game alone if frustration is a substantial problem in dieting.

Although dieting comprises the preferred embodiment of this invention, it will now be clear to those skilled in the art that the invention is also useful for behavior modification in other areas where nervous activity and frustration are involved. The invention is notatably useful in a game to stop smoking. Like compulsive eating, smoking is a habit, and is often a product of nervous energy. The system of positive reinforcement exemplified by the preferred embodiment disclosed hereinabove, including rewards, cautions and outlets for frustration can be easily applied to a game for stopping smoking. Such a game would employ a path to a goal of reduced or eliminated smoking, said path divided into increments of reduced smoking. Legends along the path would encourage the player to stop smoking, and meter out rewards for progress gained; the changing playing pieces, analogous to the changing figures of FIG. 2, would depict progressively healthier individuals; and, an initial progress-by-time section would associate recommended behavior with progress, and so forth.

It should be understood that the present invention is not limited to the exact devices and instrumentalities described herein. Additional embodiments of the present inventive concept will now be apparent to those skilled in the art. Accordingly, reference should be made to the appended Claims rather than the foregoing Specification as defining the true scope of the subject invention.

I claim:

1. A game for encouraging adherence to a self-improvement program, comprising:

(a) a board having depicted thereon a path to a goal of said program;

(b) a plurality of playing pieces for at least one player, said playing pieces representing stages of development in the self-improvement program, and said playing pieces adapted to mark the current position of said at least one player progressing along the path;

(c) means for allocating rewards for said at least one player for progress toward said goal; and, (d) means for securing moral support for said at least one player from competing players, from non-players and from internal resources of said at least one player, said means comprising:

legends at spaced intervals along said path directing said at least one player's attention to benefits of adherence to the program;

badges to be worn by said at least one player, said badges soliciting moral support;

caution cards to be read by said at least one player when tempted to give up the program, said caution cards suggesting continued adherence to the program; and, frustration cards to be read by an unsuccessful player who progresses backwards along the path to the goal, said frustration cards authorizing activities which direct frustration of said unsuccessful player toward harmless objects and away from said program.

2. The game of claim 1, wherein said self-improvement program is a diet, said path segmented to represent incremental weight loss from a starting weight to a desired weight, said desired weight being said goal; said playing pieces depicting progressively slimmer bodies, whereby said at least one player is reinforced by a visible improvement in appearance.

3. The game of claims 1 or 2, wherein progress along an initial portion of said path is related to elapsed time, in order to direct players' mental attitudes toward the goal, without concern for initial success in progress toward that goal.

4. The game of claims 1 or 2, wherein said means for allocating rewards for said at least one player comprises reward cards authorizing enjoyable activities for said at least one player, said reward cards being available to said at least one player upon reaching spaced increments of progress upon the path to the goal.

5. The game of claim 4, wherein said means for rewarding said at least one player further comprises authorized reward snacks, said snacks of substantially 300 calories, and said snacks authorized upon weight loss of three pounds.

* * * * *